United States Patent [19]

Buse

[11] 4,035,104

[45] July 12, 1977

[54] SELF-PRIMING CENTRIFUGAL PUMP

[75] Inventor: Frederic Buse, W. Allentown, Pa.

[73] Assignee: Ingersoll-Rand Company, Woodcliff Lake, N.J.

[21] Appl. No.: 750,026

[22] Filed: Dec. 13, 1976

Related U.S. Application Data

[63] Continuation of Ser. No. 614,963, Sept. 19, 1975, abandoned.

[51] Int. Cl.[2] ..... F04D 9/00

[52] U.S. Cl. ..... 417/202; 417/203

[58] Field of Search ..... 417/199 A, 201, 202, 417/203, 205

[56] References Cited

U.S. PATENT DOCUMENTS

| | | | |
|---|---|---|---|
| 862,867 | 8/1907 | Eggelston | 417/395 |
| 2,472,802 | 6/1949 | Bentley | 417/202 |
| 2,563,912 | 8/1951 | Belinkin | 417/547 |
| 3,451,290 | 6/1969 | Wildhaber | 74/804 |
| 3,578,880 | 5/1971 | Cygnor | 417/202 |
| 3,644,061 | 2/1972 | McFarlin | 417/203 |
| 3,811,797 | 5/1974 | Lewis | 417/202 |

*Primary Examiner*—Carlton R. Croyle
*Assistant Examiner*—G. P. LaPointe
*Attorney, Agent, or Firm*—Bernard J. Murphy

[57] ABSTRACT

A self-priming centrifugal pump including a priming piston disposed in a priming chamber which communicates with the pumping chamber to receive fluid therefrom. During priming, the priming piston is driven by the impeller shaft through an eccentric to discharge such fluid from the priming chamber. During normal operation of the pump, that is after the pump has been successfully primed, the priming piston is retained out of driven relationship with the eccentric by fluid supplied from the pumping chamber, thereby preventing the priming piston from taking power from the pump during such normal operation.

7 Claims, 3 Drawing Figures

SELF-PRIMING CENTRIFUGAL PUMP

Figure 1:
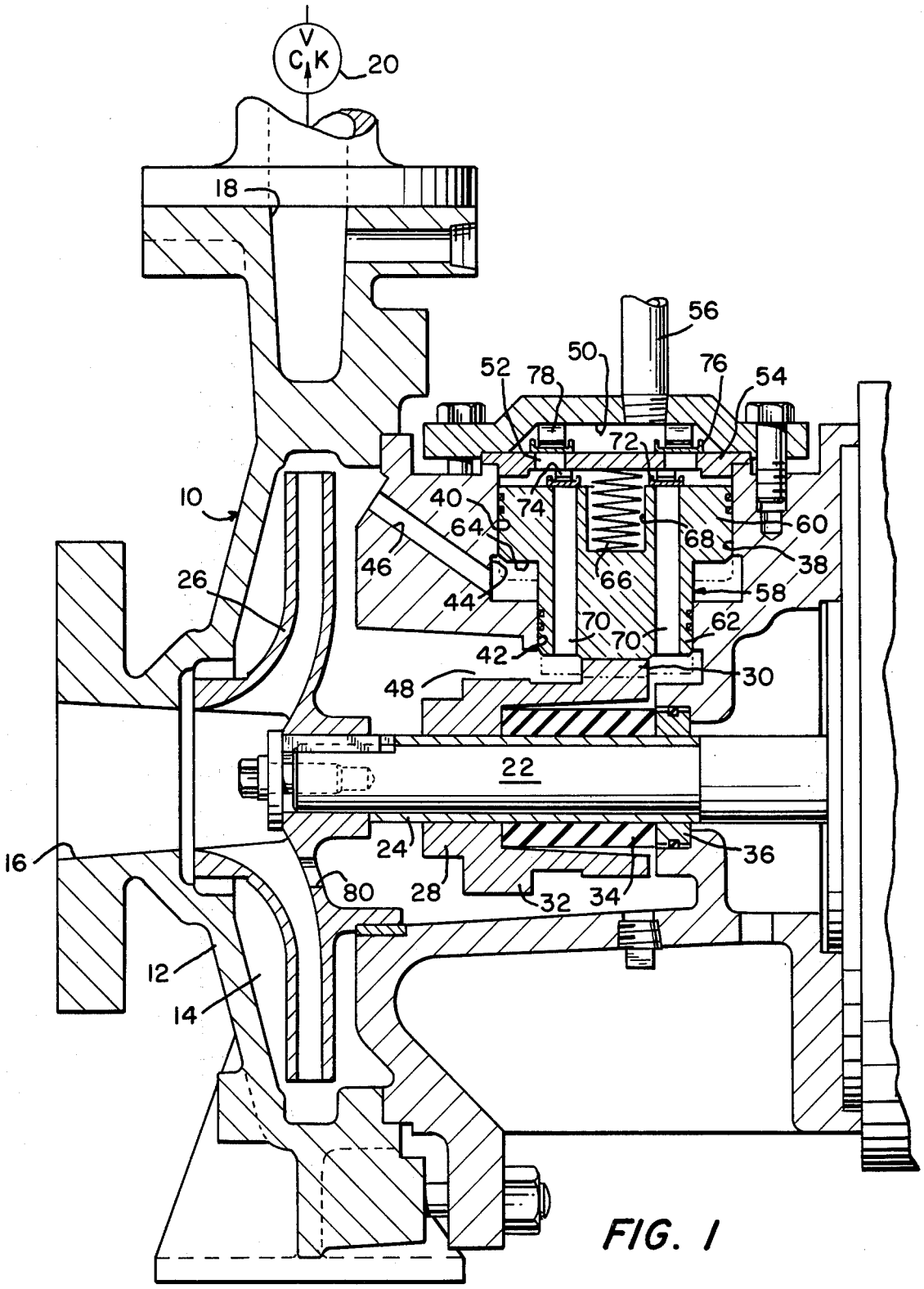

This is a continuation, of application Ser. No. 614,963 filed 9/19/75 now abandoned.

The present invention relates to centrifugal pumps and more particularly to the provision of a new and improved self-priming centrifugal pump.

Conventionally, self-priming centrifugal pumps generally are of two basic types. One of these types includes a large suction and/or discharge tank contained in the pump housing and connected to recirculate liquid through the pumping chamber for priming purposes. Such tanks are initially provided with a supply of the liquid to be pumped; and, during priming, the pump impeller is rotatably driven to recirculate such liquid from the tank or tanks through the pumping chamber, whereby gas in the pumping chamber becomes entrained with the recirculated liquid. The entrained gas is stripped or separated from the liquid in the tank or tanks and discharged to atmosphere or elsewhere, this process continuing until the pump has been successfully primed. Such form of self-priming pump, however, during normal pumping is generally of lower efficiency than a corresponding pump without the described self-priming arrangement. Also, a different pump housing-tank unit must normally be provided for each different size of pump as well as for pumps including impellers of different diameter and pumps including open and closed impellers. Moreover, this type of self-priming pump, of course, undesirably requires the mentioned large suction and/or discharge tank and normally necessitates both the mentioned discharge valve and also a check valve for preventing the pumped liquid from siphoning the tank or tanks during normal operation of the pump - that is, after the pump has been successfully primed and is operating in its normal manner.

The other basic conventional type of self-priming centrifugal pump employs a standard casing and impeller in conjunction with a liquid piston type of priming wheel. This form of pump, of course, permits the same size of priming wheel to be employed in pumps including different diameter impellers, but requires that the priming wheel be continuously driven throughout the normal operation of the pump and thereby undesirably takes horsepower during the normal pump operation thereby reducing the efficiency of the pump. In addition, the priming wheel of such a pump must be initially primed with a small amount of liquid which can readily evaporate, requiring at least in some instances that such liquid be frequently replenished. Furthermore, the beforementioned liquid piston ring requires the maintenance of close running clearances; and the priming wheel can be difficult to procure in stainless steel or somewhat exotic materials.

An object of the present invention is to provide a new and improved self-priming centrifugal pump including a priming means which does not adversely affect the normal operation of the pump — that is, which does not adversely affect the operation of the pump after the pump has been successfully primed.

Another object of the invention is to provide a new and improved self-priming centrifugal pump including a priming means which does not require any liquid for initial priming.

Another object is to provide a new and improved self-priming centrifugal pump including a priming means which is particularly constructed and arranged such that the same embodiment thereof may be alternatively employed in pumps of different size and/or different impeller size.

Another object is to provide a new and improved self-priming centrifugal pump including a priming means which is particularly constructed and arranged such that the same embodiment thereof may be alternatively employed in either horizontal or vertical orientation and in either horizontal or vertical pumps.

Other objects and advantages of the invention will become apparent from the following description taken in connection with the accompanying drawings wherein, as will be understood, the preferred embodiment of the invention has been given by way of illustration only.

In accordance with the invention, a self-priming centrifugal pump may comprise housing means containing a pumping chamber having inlet and outlet means, rotary drive shaft means, rotary impeller means connected to the drive shaft means to be rotatably driven thereby and operatively associated with the pumping chamber for pumping fluid therethrough during its driven rotation, priming piston means movable for priming the pump and operatively associated with the drive shaft means to be drivingly moved for such priming upon rotation of the drive shaft means, and biasing means for causing the priming piston means to be retained out of said operative association with the drive shaft means during normal operation of the pump and permitting said operative association for the priming.

Figure 2:
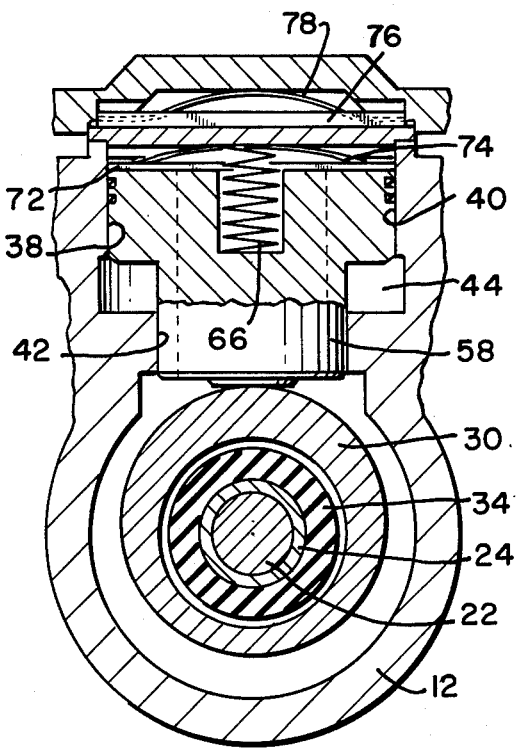
Figure 3:
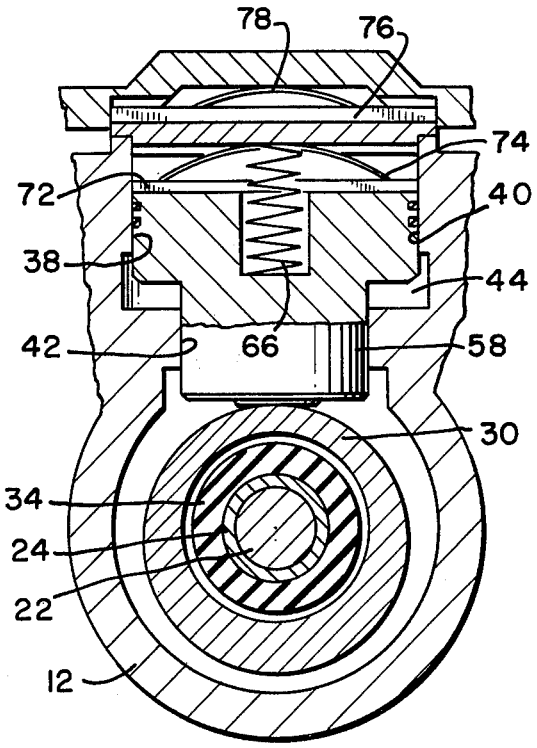

Referring to the drawings:

FIG. 1 is an elevational sectional view of a horizontal self-priming centrifugal pump constructed in accordance with one embodiment of the invention; and FIGS. 2 and 3 are fragmentary, elevational sectional views illustrating the priming means of the pump of FIG. 1 in two different operating positions during the priming of such pump.

Referring more particularly to the drawings wherein similar reference characters designate corresponding parts throughout the several views, FIGS. 1 through 3 illustrate an embodiment of the invention in the form of a horizontal self-priming centrifugal pump, it being understood however that such horizontal form of pump has been shown for the purposes of illustration only and the embodiment of priming means shown in the illustrated pump is capable of employment in both horizontal and vertical pumps.

As shown in FIG. 1, the pump 10 comprises a housing or casing 12 containing a pumping chamber 14 which communicates with an axial inlet 16 and is connected to an outlet 18 provided with a check valve designated generally as 20. The pump drive shaft 22 has a sleeve 24 affixed therearound and is rotatably supported by conventional bearings (not shown). The drive shaft 22 extends horizontally in the housing 12 and at one end is connected to a conventional rotary output drive motor (not shown) to be rotatably driven by such motor. A centrifugal impeller 26 is affixed to the other end of the drive shaft 22 for conjoined rotation therewith and disposed in the pumping chamber 14 for pumping liquid therethrough during its driven rotation. As illustrated, the impeller 26 is of the closed type having both front and rear shrouds, it being understood however that such form of impeller has been shown for the purposes of illustration only and alternatively an open impeller, or for that matter any desired form of impeller suitable for pumping liquid from the inlet 16 through the outlet 18, could be substituted for the illustrated closed impeller 26.

An annular eccentric-counter weight element, designated generally as 28, is disposed in the housing 12 and affixed around the sleeve 24 for conjoined rotation with the drive shaft 22. The eccentric-counter weight elements 28 includes an eccentric portion 30 projecting to one side of the longitudinal axis of the drive shaft 22 for purposes to be hereinafter described and also a counter weight portion 32 projecting to the opposite side of the longitudinal axis of the drive shaft 22 from the eccentric portion 30 and serving during rotation of the element 28 to counter the unbalanced forces generated by rotation of the eccentric portion 30 and prevent vibration. As shown in FIG. 1, the eccentric portion 30 may be formed on a sleeve part of the element 28 and spaced from the shaft carried sleeve 24 by an annular seal 34 which encircles the shaft carried sleeve 24 and is clamped into position by the elements 24, 28 and a retaining member 36.

The housing 12 contains a priming chamber 38 which is aligned with, and as disposed above, the eccentric portion 30 of the element 28. The illustrated priming chamber 38 includes an upper piston guide portion 40, a lower piston guide portion 42, and a therebetween intermediate portion 44 of greater cross-section than the portions 40, 42 such intermediate portion 44 communicating through a passage 46 with the pumping chamber 14 adjacent the periphery of the impeller 26 to receive fluid from adjacent the periphery of the pumping chamber 14. The communication between the pumping chamber 14 and the chamber intermediately portion 44 may, of course, include a filter or other suitable separating means (not shown) in the event that the fluid to be handled by the pump is a dirty liquid. The lower end of the portion 42 of the priming chamber 38 communicates with the pumping chamber 14 through an annular opening or passage 48 along the element 28 to receive fluid from the pumping chamber 14. The upper end of the priming chamber 38 communicates with a gas discharge chamber 50 by means of openings or passages 52 formed through a valve plate 54 bounding the lower end of the gas discharge chamber 50, the discharge chamber 50, in turn, being connected to a gas discharge conduit 56.

A priming piston, designated generally as 58, is slidably disposed in the priming chamber 38 for vertical axial movement therein towards-and-away from the drive shaft 22 and its carried eccentric portion 30 of the element 28. The priming piston 58 is preferably formed of a material such that it does not require lubrication. The priming piston 58 includes an enlarged head portion 60, slidably in the upper portion 40 of the priming chamber 38, and a depending stem portion 62, formed integrally with the head portion 60, which projects downwardly from the head portion 60 through the chamber intermediate and lower portions 40, 42. The piston stem portion 62 is, as will be noted substantially spaced from the circumferential wall of the intermediate portion 44; and at the junction of the piston portions 60, 62, the piston 58 includes an annular shoulder 64 open to the intermediate chamber portion 44 whereby fluid supplied into such chamber portion 44 through the passage 46 is cooperative with the shoulder 64 to upwardly bias the piston away from the shaft 22 and its carried eccentric portion 30. Suitable sealing means, shown for purposes of illustration as a plurality of sealing rings, are disposed around the piston head portion 64 in the upper chamber portion 40 and the piston stem portion 62 in the chamber lower portion 42, for preventing fluid flow through such chamber portions around the piston 38.

A coil spring 66, disposed in an axial recess 68 in the piston head 60 and at its opposite ends abutting the valve plate 54 and the piston 38, downwardly resiliently biases the piston 58 towards the therebelow shaft carried eccentric portion 30 and during pump priming resiliently retains the lower end of the piston 58 in engagement with the shaft carried eccentric element 30. Also, the piston 58 includes a plurality of longitudinal through bores 70 which open through its upper and lower faces, the lower ends of such bores 70 being open to continuous communication with the pumping chamber 14 through the annular passage 48. The upper end of the priming chamber 38, immediately below the valve plate 54, contains channel valving elements 72 which are resiliently biased by springs 74 to closed positions preventing flow of fluid from the upper ends of the piston contained passages 70 into the upper end of the priming chamber 38. In addition, the gas discharge chamber 50 contains similar channel valving elements 76 resilently biased by springs 78 to closed positions wherein they prevent passage of fluid from the upper end of the priming chamber 38 to the gas discharge chamber 50 through the openings 52 formed in the valve plate 54.

Upon pump start-up, the pumping chamber 14 contains air or gas rather than the liquid to be handled by the pump. The pressure of this air or gas in the pumping chamber 14 is, as will be understood, sufficiently great to overcome the biasing forces of the springs 74 thus enabling the air to move the channel valving elements 72 from their closed positions to their open positions, but not sufficiently great to either overcome the biasing force of the springs 78 or drive the piston 58 upwardly away from the eccentric portion 30. Such air flows from the pumping chamber 14 to the annular passage 48 around the element 28, either by passing around the periphery of the impeller 26 or through impeller contained balance holes such as the one designated as 80, and thence passes upwardly through the piston contained passages 70, shifts the valving elements 72 to their open positions and enters the upper end of the priming chamber 38 above the priming piston 58 where, the valving elements 76 being closed, it remains. Simultaneously, air from adjacent the periphery of the impeller 26 passes through the passage 46 into the priming chamber intermediate portion 44, but due to its low pressure is unable to drive the piston 58 upwardly away from the eccentric 30. Hence, the driven rotation of the drive shaft 22 by its drive motor at this time causes the eccentric portion 30 of the element 28 to repetitively upward displace the piston 58 from its lowermost position of FIG. 3 to its uppermost position of FIG. 2, whereupon the piston 58 is again moved downwardly to its FIG. 3 position by the spring 66. During each such upward displacement or stroke of the priming piston 58 by the eccentric 30, the valving elements 72 return to their closed positions whereupon the piston upward movement causes the air pressure in the upper end of the priming chamber 38 to overcome the springs 78 and open the valving elements 76 and such air passes into the discharge chamber 50 and thence flows through the discharge conduit 56. During each such downward movement of the priming piston 58, the valves 76 are, of course, automatically reclosed by their springs 78 whereupon the valving elements 72 are again opened by the air in the before described manner. Thus, the pump 10 is primed while the check valve 20 prevents the priming from evacuating the pump discharge line. After the pump has been successfully primed, liquid at a portion of the discharge pressure flows through the passage 46 into the priming chamber intermediate portion 44 whereupon the liquid cooperates with the priming piston annular shoulder 64 to lift the priming piston 58 off of the eccentric portion 30 and also cause the priming piston 58 to hold the valving elements 72 against the valve plate 54 in the closed positions preventing flow of liquid through the piston contained passages 70 into the chamber upper portion 40. Throughout the normal operation of the pump 10, such fluid continuously cooperates in this manner with the annular shoulder 64 such that the priming piston 58 is retained out of operative engagement with the eccentric portion 30 throughout the normal operation of the pump 10. Resultantly, the priming piston 58 is prevented from exerting any load or drag on the pump 10 throughout the normal operation of the pump 10; and the pump 10 throughout its normal operation possesses the efficiency of a standard, non-self-priming pump. Also, as the priming piston 58 is so retained out of operative engagement with the eccentric portion 30, wear of the components 30, 58 is precluded throughout the normal pump operation while, the valving elements 72 being retained in closed positions, liquid flow from the pump 10, and gas flow back into the pump 10, through the priming chamber 38 is precluded.

In the event that the pump 10 at any time requires repriming, the pressure of the liquid in the priming chamber intermediate portion 44 is released to permit the piston 58 to be returned to its lowermost position by the spring 66 whereupon the pump is again primed in the before described manner.

From the preceding description it will be seen that the invention provides new and improved means for accomplishing all of the beforestated objects and advantages. It will be understood however that, although only a single embodiment of the invention has been illustrated and hereinafter described, the invention is not limited merely to this single embodiment but rather contemplates other embodiments and variations within the scope of the following claims.

Having thus described my invention, I claim:

1. A self-priming centrifugal pump comprising housing means containing an annular pumping chamber having inlet and outlet means, rotary drive shaft means, rotary impeller means connected to said drive shaft means to be rotatably driven thereby and operatively associated with said pumping chamber for pressurizing fluid within said housing means and for pumping fluid through said pumping chamber, centrifugally, during its driven rotation, priming piston means movable within said housing for priming of the pump and operatively associated with said drive shaft means to be drivingly moved for said priming upon rotation of said drive shaft means, biasing means for causing said priming piston means to be retained out of said operative association with said drive shaft means during normal operation of the pump and permitting said operative association for said priming; further including a priming chamber, a discharge chamber, first and second passage means for communicating said priming chamber with said pumping chamber, and said discharge chamber with said priming chamber, respectively, and first and second valving means operatively disposed across said first and second passage means, respectively, and normally closed to prohibit communication between said priming and pumping chambers and said discharge and priming chambers; and wherein said first valving means comprises means operative in response to pressurized fluid, in said pumping chamber, to open said first valving means and admit pressurized fluid, from said pumping chamber, through said first passage means and said first valving means, into said priming chamber.

2. A self-priming centrifugal pump according to claim 1, wherein said priming piston means is biased into said operative association with said drive shaft means, and said biasing means comprises passage means for causing fluid from said pumping chamber to retain said priming piston means out of said operative association with said drive shaft means during normal operation of the pump.

3. A self-priming centrifugal pump, according to claim 1, wherein said valving means comprise means for preventing discharge of fluid from said priming chamber during normal operation of the pump.

4. A self-priming centrifugal pump, according to claim 1, wherein said priming piston means is operatively associated with said valving means for causing said valving means to prevent discharge of fluid from said priming chamber during normal operation of the pump.

5. A self-priming centrifugal pump according to claim 1, wherein said pumping chamber communicates with one end of said priming chamber, and further comprising passage means for conveying fluid from said end of said priming chamber to the other end thereof.

6. A self-priming centrifugal pump according to claim 1, further comprising eccentric means, rotatably driven by said drive shaft means, for connecting said priming piston means to said drive shaft means during said priming.

7. A self-priming centrifugal pump according to claim 6, further comprising counter weight means, associated with said drive shaft means, for countering the forces generated by the driven rotation of said eccentric means.

* * * * *